United States Patent [19]

Ray et al.

[11] Patent Number: 4,977,907

[45] Date of Patent: Dec. 18, 1990

[54] TOBACCO BLOCK SLICING MACHINE

[75] Inventors: Eric T. Ray, Salisbury; Peter A. Vigg, Andover, both of England

[73] Assignee: GBE International PLC, Andover, England

[21] Appl. No.: 83,789

[22] PCT Filed: Nov. 12, 1986

[86] PCT No.: PCT/GB86/00700

§ 371 Date: Jul. 2, 1987

§ 102(e) Date: Jul. 2, 1987

[87] PCT Pub. No.: WO87/02868

PCT Pub. Date: May 21, 1987

[30] Foreign Application Priority Data

Nov. 13, 1985 [GB] United Kingdom ..... 8528002

[51] Int. Cl.[5] ..... A24B 3/07; A24B 3/18

[52] U.S. Cl. ..... 131/290; 131/306; 131/327; 131/305; 131/117

[58] Field of Search ..... 131/305, 290, 116, 117, 131/118, 306, 327

[56] References Cited

FOREIGN PATENT DOCUMENTS 1139419 11/1962 Fed. Rep. of Germany .

58-81773 5/1983 Japan .

*Primary Examiner*—V. Millin

*Attorney, Agent, or Firm*—James Creighton Wray

[57] ABSTRACT

A slicing machine comprises a frame having a support surface (10) onto which the block of material to be sliced is placed, a cutter assembly (14) for moving in a cutting plane transversely of said support surface, said cutter assembly being movable between upper and lower positions (K, K1) and a pusher (11) for moving the block of material in stepwise fashion towards said cutting plane, said pusher being movable from a rearmost position (A) in a forward direction during successive slicing operations to a forwardmost position (A1) close to the cutting plane. A pivoted retainer (22) is pivotally connected to the frame and movable between a non-retaining position and a retaining position for retaining and supporting the last slide of the block. The retainer is actuated by a pneumatic rotary actuator. The pusher moves toward its rearmost position as soon as the last slice is in a retained and supported situation. Preferably the retainer comprises a substantially U-sectioned elongate member (21) having a base and sides pivotally mounted at its sides on a fixed part of said machine, said member being movable between a raised inoperative position where it remains during each slicing operation and a lower operative position.

6 Claims, 3 Drawing Sheets

TOBACCO BLOCK SLICING MACHINE

BACKGROUND TO THE INVENTION

This invention relates to a slicing machine particularly for the cutting of laminated material such as tobacco which for reasons of ease of transport and storage tobacco in the form of lamina or whole leaf is formed into relatively high density blocks, (most commonly known as cases, hogsheads or bales).

When the tobacco is required for processing into cigarettes the blocks of tobacco are required to be opened into individual leaves or lamina with the least damage to the tobacco as possible. The process of separating the tobacco has been achieved in various ways, the principle means being as follows:

1. A batch process whereby the tobacco block is inserted into a chamber and subjected to a steaming process whereby the tobacco is heated and moistened by condensation. The tobacco block is then opened by feeders utilising a tumbling and doffering action and finally conditioned in a relatively large rotating cyclinder where further moisture is added.

2. A continuous opening machine where blocks of tobacco are conveyed onto rotating doffers and steam probes as described for example in U.K. Pat. Nos. 1,364,839; 1,136,438 and 2,007,962 and then delivered to a relatively large rotating cylinder where further moisture is added.

3. A continuous opening and conditioning machine whereby steam jet knives rotate above a block of tobacco with the laminations horizontally disposed as described in patent application Ser. No. WO82/02324.

4. Dry slicing the block either (a) parallel with the strata or (b) at right angles to the strata and then adding moisture within a relatively large cylinder. This process is commonly known as direct cylinder conditioning (DCC).

The invention described below is preferably associated with the process described in (4) above.

OBJECT OF THE INVENTION

An object of the invention is to increase the output potential of a dry case slicing machine whilst maintaining continuity of product flow.

SUMMARY OF INVENTION

According to the invention there is provided a slicing machine comprising a support surface onto which the block of material to be sliced is placed, a cutter assembly for movement in cutting a plane transversely of said support surface, said cutter assembly being movable between upper and lower positions (K,K1), pusher means for moving the block of material in stepwise fashion towards said cutting plane, said pusher means being movable from a rearmost position (A) in a forward direction during successive slicing operations to a forwardmost position (A1) close to the cutting plane, characterized by means for retaining and supporting the last slice of the block movable between a non-retaining position and a retaining position, means for actuating said retaining and supporting means between said positions, said pusher means thereby being movable towards its rearmost position as soon as the last slice is in a retained and supported situation.

Further according to the invention there is provided a method of slicing a block of material comprising a. supporting said block on a support surface b. pushing said block to a first position by pusher means, c. effecting a first slicing operation in a downward direction the produce a slice standing on its narrow edge, d. pushing said block by continued advancing movement of said pusher means to a second position whilst simultaneously pushing the first slice of the block off the support surface, e. effecting successive slicing and pushing off of the resulting slices until the last slicing operation for that block has taken place, f. retaining the last slice of the block in position on its narrow edge, g. withdrawing the pusher means, and h. releasing said last slice after said pusher means has commenced its return movement.

The last slice of a block of tobacco may be released independently of the block re-loading cycle.

Preferably the cutting machine can retain the last slice when cutting a block of tobacco and release the slice at the same pre-determined interval as the preceding slices of the particular block. Simultaneously the mechanisms for introducing the next block of tobacco can operate in order that the first slice of the next block can take place within the same predetermined intervals as preceding slices of previous blocks.

BRIEF DESCRIPTION OF DRAWINGS

The invention will now be described by way of an example with reference to the accompanying drawings in which.

DESCRIPTION OF PREFERRED EMBODIMENTS

Figure 1:
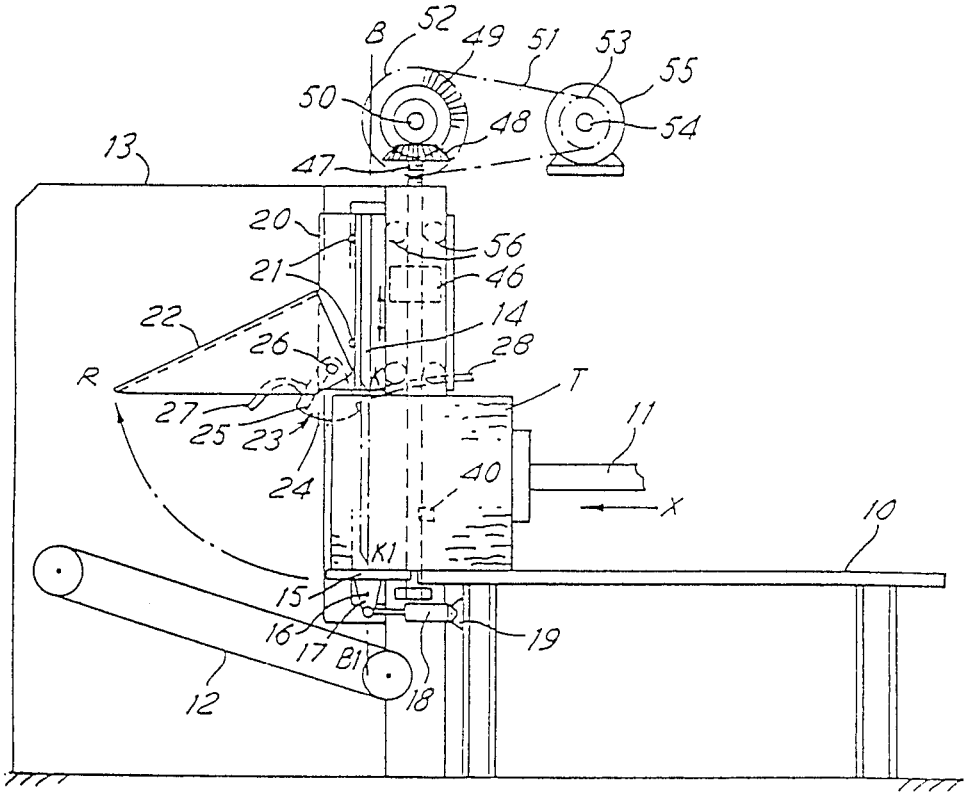
FIG. 1 is a side elevation of the machine showing the position of last slice retainer during normal cutting.

The slicing machine shown in the drawing includes a cutting mechanism, a pusher mechanism and a conveying apparatus. However, since these are well known the supporting structure and driving mechanism have been omitted for simplicity. Furthermore, control mechanism using well-known technology whereby the reciprocation of the cutting blade and actuation of the pusher are coordinated is not shown or described.

In FIG. 1 the slicing machine is shown with a support platform 10 for a tobacco bale to be sliced and a pusher arm 11 movable by means (not shown) from a rearmost position A for loading through a series of steps in a forward direction during successive slicing operations to a forwardmost position A1. A cutter blade 14 is reciprocated in a vertical direction, the cutting edge being movable in a plane B, by means described below. The slices are carried away by a take-off conveyor 12 mounted on a supporting framework shown generally and schematically at 13.

The cutter moves from an upper position K to a lower position K1 just above an anvil 15 pivotally mounted at 16 on brackets 17, the upper surface of the anvil normally lying in the plane of the upper surface of the support platform 10.

The anvil 15 can be pivoted out of the normal position (FIG. 1) into a tilted position for the purpose to be described by means of a hydraulic or pneumatic ram 18 mounted between a bracket 17 and a lug 19.

A U sectioned holder 20 is attached by screws 21 to the back of the cutter blade 14 and accordingly reciprocates together with the cutter blade.

To a fixed part of the frame 13 there is pivotally mounted a U-sectioned slice retainer 22 movable between a raised inoperative position R and a lowered operative position R1. The slice retainer 22 is drivable between these extreme positions R, R1 by means of a rotary actuator 23 particular of the kind marketed under the trade mark Kinetrol having a chamber 24 of quadrant form in which a movable vane 25 is connected to an output shaft 26, the vane being movable by air pressure fed through pipe 27 or 28 according to the required direction of movement. The chamber 24 is secured to the frame work 13 and has its output shaft 26 connected to a shaft fixed to the slice retainer 22 coaxial with the pivoting axis of the slice retainer.

The cutter blade 14 may be mounted in a known manner on a pair of support plates 45 to each of which is attached a ball nut 46 having a threaded bore engaged by a screw 47. The upper end of each screw 47 has a bevel gear 48 meshing with a further bevel gear 49 mounted at the end of a cross shaft 50. The cross shaft 50 driven by a timing driving belt 51 passing around pulleys 52,53 the latter pulley 53 being mounted on the shaft 54 of a motor 55.

The support plates 45 are each provided with four bevel wheels 56 which engage a guide rod 57 attached to a box member 58 forming part of the framework 13.

In operation a bale of tobacco T is loaded onto the platform 10.

On actuation of the control mechanism the tobacco is then pushed forward (direction arrow X) by the pusher 11 so that the leading edge of the block is positioned the required distance from the cutting plane of the knife B-B1 for the first cut. The leading edge may be detected by a photo-electric device 40 mounted on the supporting framework adjacent the cutting plane B and positioning achieved by an encoder or similar device.

The control mechanism can be adjusted to determine the slicing and indexing timing according to the throughput requirement.

The knife is now driven down to position K1. The cut slice is then retained between the U-sectioned holder 20 and the cutter 14. When the cutter is returned to position K the slice is free to fall away onto a take-off conveyor 12. The pusher 11 then pushes the block forward the distance equivalent to a slice thickness determined by the control mechanism ready for the next cut. The cutting sequence continues to the last cut. The number of slices per case is an operator input to the control mechanism which incorporates known devices, such as electronic counters and programmable logic controllers.

When the last cut has been made the forward slice will be released when the knife returns to position K. The last slice is prevented from falling onto the conveyor 12 by the retainer 22 which swings down to a position R1 as shown in the overhead view of FIG. 2 from the position R shown in FIG. 1, the swinging or pivoting motion being powered by the rotary actuator 23.

Figure 3:
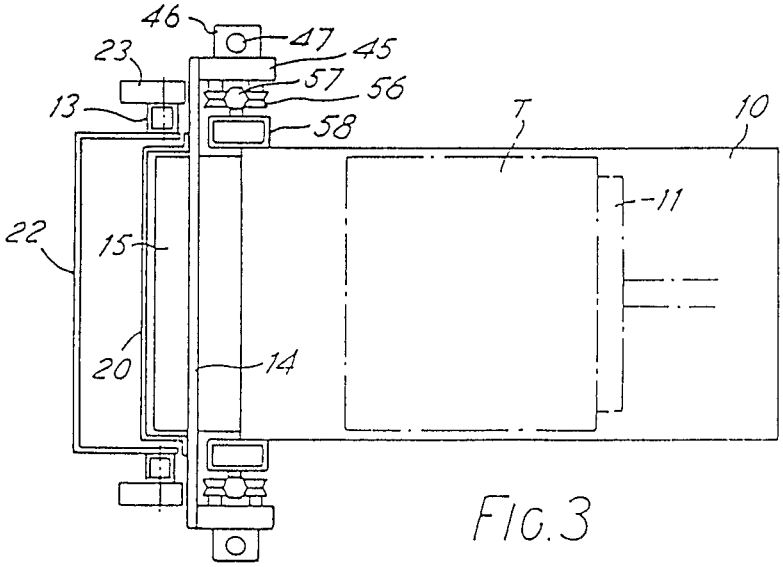
FIG. 3 is a part plan part sectional view taken in the direction of line Y—Y in FIG. 2.

As shown in FIG. 3, the pusher 11 is then moved forward to position A1 and the pivoted anvil 15 moved to a tilting position from the horizontal position to assist the slice to fall into the retainer 22. The pusher can then return to position A so that a new bale of tobacco can be introduced in front of the pusher and during this time the retainer 22 can be pivoted back to position R hence releasing the slice at a moment which will give an equal time between slices released for a particular block. The anvil 15 is returned to its normal horizontal position at the same time as the retainer 22 is pivoted up.

Figure 4:
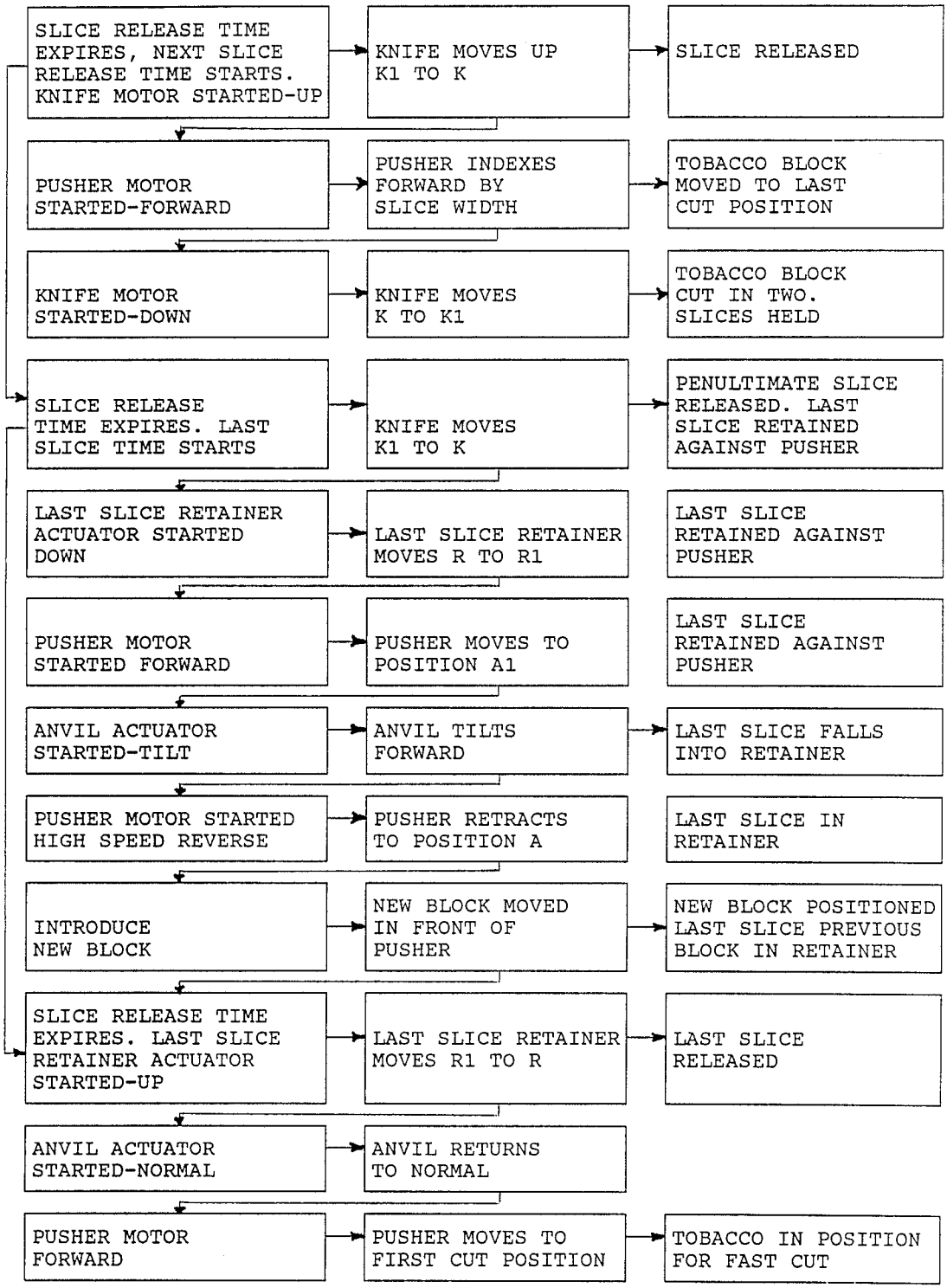
FIG. 4 is a flow diagram of the operations of the control circuit; mechanical movements of the knife, slice retainer, pusher and anvil; and tobacco status.

The sequence of movements of the above described machine can be followed in the flow diagram set out in FIG. 4.

It is preferable, for reasons of consistent tobacco flow, that when using a device that slices tobacco blocks, the slices (of equal volume) are released at equal intervals. Without the use of the invention disclosed herein there is excessive time required between releasing the last slice of a case and the first slice of the next case. This is best illustrated by examining the following example.

EXAMPLE

Tobacco blocks 28"×28"×40"(71.12 cm×71.12 cm×101.6 cm) long are required to be cut into 5"(12.7 cm) slices at the maximum flowrate possible.

TIME SCALING

Times quoted are for reasonable maximum speeds appropriate to this type of device.

Figure 2:
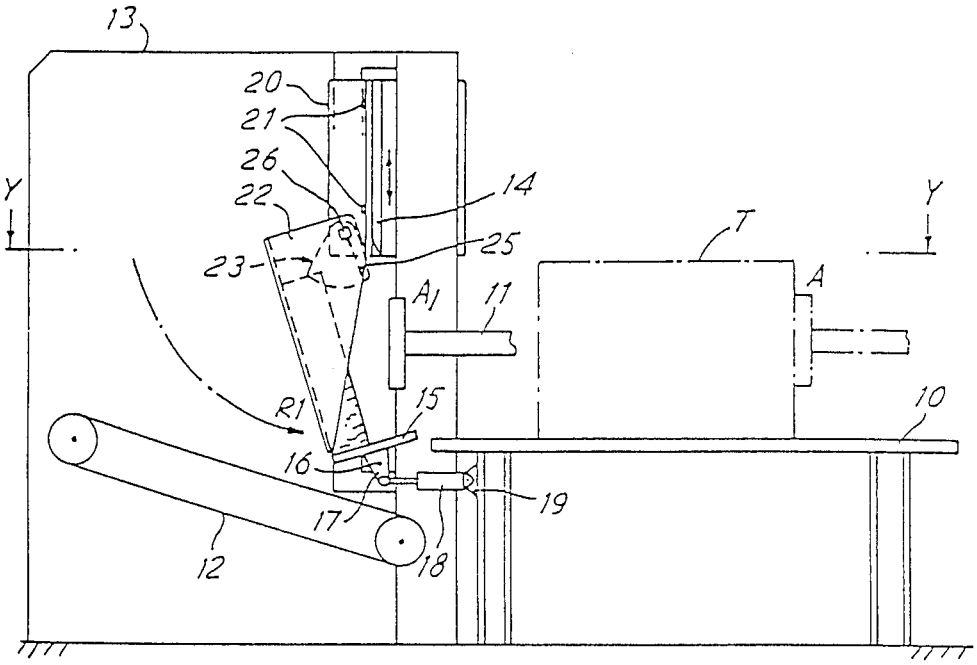
FIG. 2 shows the machine in which the last slice retainer is in a position to retain the last slice.

(a) Without Last Slicer Retainer (but refer to FIGS. 1 and 2)

| ACTION | TIME (seconds) |
|---|---|
| Last Cut (Knife position K1) | 0 |
| Wait | Variable |
| Knife returns to position K | — |
| Slice released | |
| Wait | Variable |
| Pusher feed (5" (12.7cm)) (low speed) | — |
| Slice released | |
| Pusher returns to rearmost position A (high speed) | 6 |
| Next case introduced in front of pusher | — |
| Pusher moves forward (low speed) to 1st cut position | — |
| Cut | — |
| Wait | Variable |
| Knife returns to position K | — |
| Slice released | |

Minimum time between last slice released and first slice released from next block =6+4+4+4+4=22 seconds.

(b) With Last Slice Retainer of the present invention (see FIGS. 1 and 2).

| ACTION | TIME (Seconds) |
|---|---|
| Last cut (knife at position K1) | 0 |
| Wait | Variable |
| Knife moves to position K, slice released | 4 |
| Last slice retainer moves to position R | 3 |
| Pusher feeds (5" (12.7 cm)) at low speed | 4 |
| Slice retained | |
| Pusher returns to positin A at high speed simultaneously with | 6 |
| Last slice retainer moving to R and Slice released | 5.5 |

-continued

| ACTION | TIME (Seconds) |
|---|---|
| Next case introduced in front of pusher | 4 |
| Pusher moves forward at low speed to 1st cut position | 4 |
| Cut | 4 |
| Wait | Variable |
| Knife returns to position K and slice released | 4 |

Minimum time between last slice released and first slice released from next block $=0.5+4+4+4=12.5$ seconds.

Therefore time difference between with and without last slice retainer is 22 as opposed to 12.5 seconds respectively.

In terms of output potential last slice retained improves output performance by factor of 1.76.

We claim:

1. A slicing machine comprising a frame having a support surface (10) onto which a block of material to be sliced is placed, a cutter assembly (14) for movement in a cutting plane transversely of said support surface, said cutter assembly being movable between upper and lower positions (K, K1), pusher means (11) for moving the block of material in stepwise fashion towards said cutting plane, said pusher means being movable from a rearmost position (A) in a forward direction during successive slicing operations to a forwardmost position (A1) close to the cutting plane, means (22) pivotally connected to the frame and movable between a nonretaining position and a retaining position for retaining and supporting a last slice of the block means (23) for actuating said retaining and supporting means between said positions, said pusher means thereby being movable towards its rearmost position as soon as the last slice is in a retained and supported situation.

2. A slicing machine as claimed in claim 1, characterized in that said retaining and supporting means comprises a substantially U-sectioned elongate member (21) having a base and sides pivotally mounted at its sides on a fixed part of said machine said member being movable between a raised inoperative position where it remains during each slicing operation and a lowered operative position.

3. A slicing machine as claimed in claim 2, characterized in that said means (23) for actuating said retaining member (22) comprises a rotary actuator having a chamber of quadrant form in which a movable vane is provided connected to an output shaft coupled to the retaining member, said rotary actuator being attached to a fixed part of the machine.

4. A slicing machine as claimed in claim 3, characterized in that the base of retaining and supporting member is close to but inclined to the vertical when in its lowered operative position, the last slice leaning under its own weight against said base.

5. A slicing machine as claimed in claim 4, characterized by a pivotally mounted anvil (15) having its upper surface lying in substantially the same plane as the support surface (10), and actuating means (18) for effecting a tilting movement of said anvil, whereby the last slice is tipped by said anvil and held by said retaining and supporting means when the latter is in its lowered operative position.

6. A method of slicing a block of material comprising a. supporting said block on a support surface, b. pushing said block to a first position by pusher means, c. effecting a first slicing operation in a downward direction to produce a slice standing on its narrow edge, d. pushing said block by continued advancing movement of said pusher means to a second position whilst simultaneously pushing the first slice of the block off the support surface, e. effecting successive slicing and pushing off of the resulting slices until the last slicing operation for that block has taken place, f. retaining the last slice of the block in position on its narrow edge, g. withdrawing the pusher means, and h. releasing said last slice after said pusher means has commenced its return movement.

* * * * *